US005911174A

United States Patent [19]

Cramer et al.

[11] Patent Number: 5,911,174

[45] Date of Patent: Jun. 15, 1999

[54] CALENDER

[75] Inventors: Dirk Cramer, Duisberg; Horst Müller, Mönchengladbach; Ulrich Wagner, Wachtendonk, all of Germany

[73] Assignee: Voith Sulzer Finishing GmbH, Krefeld, Germany

[21] Appl. No.: 08/901,203

[22] Filed: Jul. 28, 1997

[30] Foreign Application Priority Data

Aug. 21, 1996 [DE] Germany ..... 196 33 671

[51] Int. Cl.[6] ..... D21G 1/00; B30B 3/04

[52] U.S. Cl. ..... 100/331; 100/161; 100/162 R; 100/168

[58] Field of Search ..... 100/155 R, 161, 100/162 R, 163 R, 164, 165, 163 A, 166, 162 B, 168, 331

[56] References Cited

U.S. PATENT DOCUMENTS

| | | | |
|---|---|---|---|
| 4,332,191 | 6/1982 | Kankaanpaa | 100/162 R |
| 4,366,752 | 1/1983 | Koski | 100/162 R |
| 4,375,188 | 3/1983 | Leiviskä | 100/162 R |
| 4,395,944 | 8/1983 | Siepermann et al. | 100/168 |
| 5,669,295 | 9/1997 | Kayser et al. . | |

FOREIGN PATENT DOCUMENTS

| | | | |
|---|---|---|---|
| 228734 | 12/1958 | Australia | 100/161 |
| 0027270 | 4/1981 | European Pat. Off. . | |
| 1123648 | 2/1962 | Germany | 100/168 |
| 3121713 | 3/1982 | Germany . | |
| 19506320 | 2/1996 | Germany . | |
| 19508352 | 9/1996 | Germany . | |
| 19508353 | 9/1996 | Germany . | |
| 19511145 | 10/1996 | Germany . | |
| 46-28965 | 8/1971 | Japan | 100/161 |
| 5-71095 | 3/1983 | Japan | 100/161 |

*Primary Examiner*—Stephen F. Gerrity
*Attorney, Agent, or Firm*—Greenblum & Bernstein P.L.C.

[57] ABSTRACT

Calender that may include two separately operable roll stacks. Each roll stack may include a top roll composed of a deflection compensation roll and a bottom roll composed of a deflection compensation roll. The two roll stacks may be arranged one atop the other.

22 Claims, 1 Drawing Sheet

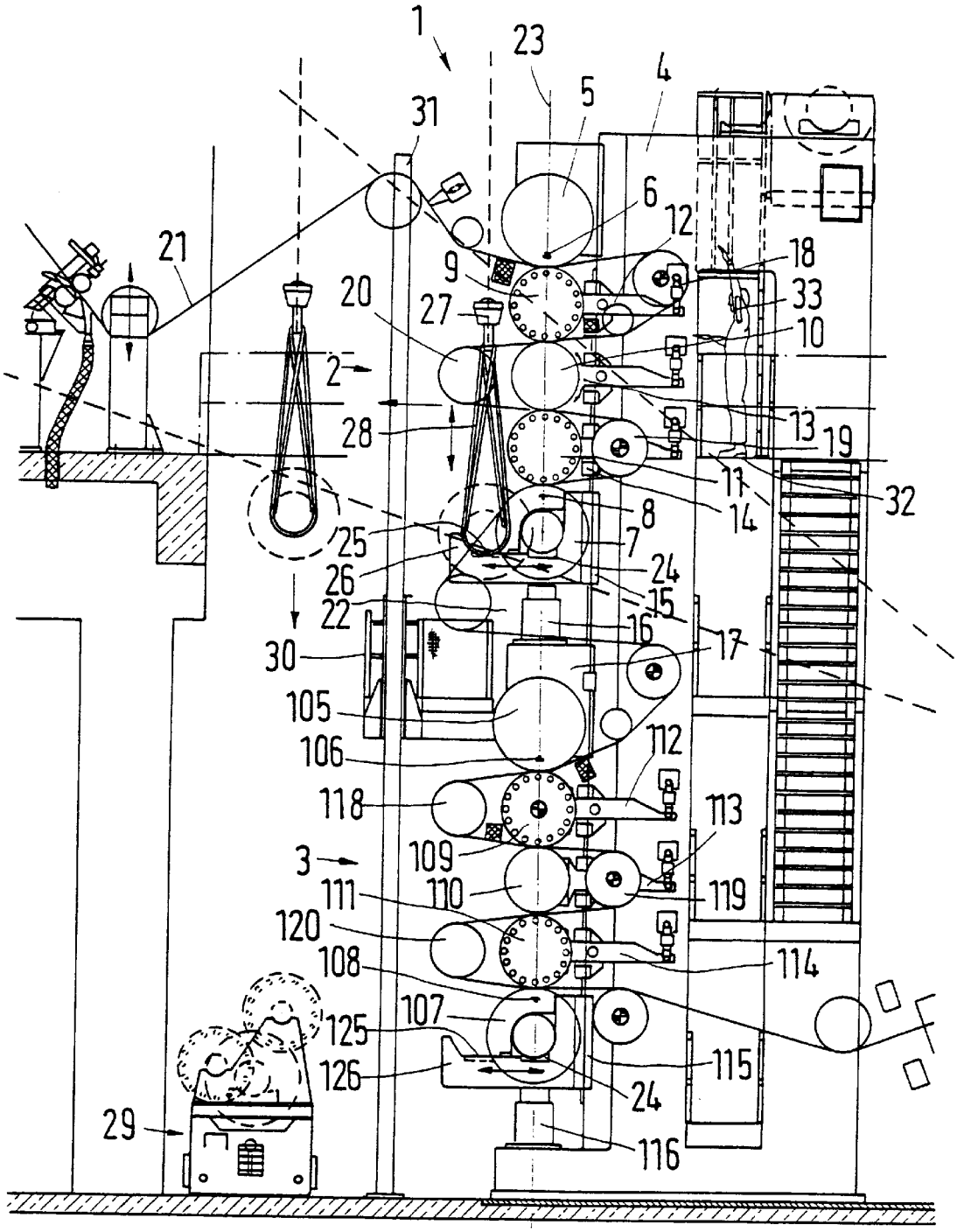
1
23
5
4
31
6
12
21
18
9
33
20
27
10
2
13
28
19
11
32
14
8
25
7
24
26
15
22
16
17
30
105
106
112
118
113
109
3
111
110
119
120
114
108
107
125
115
126
24
29
116

CALENDER

CROSS-REFERENCE TO RELATED APPLICATION

The present application claims priority under 35 U.S.C. § 119 of German Patent Application No. 196 33 671.6 filed Aug. 21, 1996, the disclosure of which is expressly incorporated by reference herein in its entirety.

BACKGROUND OF THE INVENTION

1. Field of the Invention

The invention relates to a calender with two separately operating roll stacks, each roll stack including a top roll composed of a deflection compensation roll and a bottom roll composed of a deflection compensation roll.

2. Discussion of Background Information

A calender similar in general to the above-described calender is discussed, e.g., in German Patent Application 195 08 353. Calenders of this type have been shown to be advantageous in that a material web, e.g., a paper web, is treated on both sides with practically the same results. The total number of rolls in these devices is kept lower than the number utilized in conventional multi-roll calenders, which is typically equipped with twelve rolls. Further, the control of compressive strains in individual nips is carried out with a higher degree of freedom.

However, when the calender is embodied with two separately operable roll stacks, additional space for housing the calender is required. Further, two additional calender stanchions or mounting brackets are necessary, which, as discussed in above-noted German Patent Application 195 08 353, are positioned so that the roll plane, i.e. planes formed by the axes of the rolls in a particular roll stack, for each roll stack is positioned parallel to and spaced apart from each other to form neighboring roll stacks. This results in increased investment costs, and, in some cases, retrofitting is not possible due to a limited amount of available space.

SUMMARY OF THE INVENTION

The present invention provides a calender structure of the type described above which may be reasonably priced and which may be retrofit in a substantially easy manner.

Thus, the calender of the present invention provides two roll stacks which are positioned one atop the other. Each roll stack may be separately operable.

In accordance with the present invention, the only space required in the web travel direction is the space of a single calender, which may be, e.g., approximately twice the height of a single roll stack. This variance is not a drawback, however, because in most factories, vertical space is available because of the relatively great structural height of web, e.g., paper, processing machines. The position of a reel, which is located subsequent to calenders of the type described herein, may be maintained so that the building in which the processing machine is housed may be either planned or kept shorter. Further, web guidance becomes simpler. That is, the path between the two roll stacks may be reduced, so that, during guidance between the two roll stacks, the material web may only be subjected to environmental conditions. Thus, the web has, e.g., less time to dry or cool, which provides a further advantage over the prior art. Further, a single lifting platform may be utilized for both roll stacks, which reduces installation space and maintenance work.

In a preferred embodiment of the present invention, both roll stacks may be arranged in a common machine frame to simplify the overall design of the calender. Further, the two roll stacks may be aligned with each other, so as to more easily support the upper roll stack.

In this manner, it is preferred that each roll stack includes five rolls and that the machine frame or stanchion may correspond to that of a known 12-roll calender. In many instances and applications of web processing, the calender arrangement of the present invention is intended to replace the prior art 12-roll calender. Because, in accordance with the present invention, the roll stacks are to be positioned one atop the other, in many existing processing facilities, the existing machine frame for the old calender may be retrofit and used to embody the calender of the present invention. In this manner, conversion time may be reduced to less than one-half because the old or existing machine frame does not need to be replaced with new machine frames. Thus, with respect to costs, the shorter conversion time required by the present invention generally results in less down time and, correspondingly, lower costs.

Preferably a top roll of a lower roll stack and a bottom roll of an upper roll stack may be positioned on a common bearing device. Thus, despite a division of the two roll stacks into different functional units which may be separately operable, a common fixing and, therefore, a common reference point may be established. In this manner, controlling the operation of the calender may be simplified.

Preferably at least the bottom roll of the upper roll stack may be supported in bearing recesses, which may be coupled to a roll-out rail protruding crosswise (lateral) to a plane formed by an alignment of the roll axes in the roll stack. Since the bottom rolls are each composed of, or formed by, deflection compensation rolls, the rolls generally have only a relatively short pin. Thus, it may be difficult to fit removing tools onto these pins or rolls. However, by positioning the roll-out rails on the bearing recesses, the bottom rails may be rolled out of the plane of the roll stack before engaging the roll with removing tools. If the rolls are engaged in the rolled-out position, they may be guided past the other rolls of the roll stack.

Advantageously, at least intermediary rolls of the roll stack may be supported on levers. The calender may, therefore, be formed at least in part as a "classic" lever calender so that conventional control strategies may be utilized.

It may also be advantageous that a material web travel path may be guided between the bottom roll of the upper roll stack and the top roll of the lower roll stack. The material web may then be treated from or on different sides in both roll stacks without the guidance of the material web becoming unnecessarily complicated. A wide open "reversing nip" may be formed between the bottom roll of the upper roll stack and the top roll of the lower roll stack.

Accordingly, the present invention may be directed to a calender that may include two separately operable roll stacks. Each roll stack may include a top roll composed of a deflection compensation roll and a bottom roll composed of a deflection compensation roll. The two roll stacks may be arranged one atop the other.

According to another feature of the present invention, both roll stacks may be arranged in a common machine frame.

According to another feature of the present invention, each roll stack may include five rolls and the machine frame may include a 12-roll calender machine frame.

According to still another feature of the present invention, the calender may also include a bearing device and the top roll of a lower roll stack and the bottom roll of an upper roll stack may be located on the bearing device.

According to a further feature of the present invention, a center of each roll may be arranged in a common plane and the calender may include roll out rails protruding lateral to the common plane and bearing recesses adjacent to the roll out rails. At least the bottom roll of an upper roll stack may be supported in the bearing recesses.

According to still another feature of the present invention, a plurality of intermediary rolls may be positioned between the top roll and the bottom roll. The intermediary rolls may be supported on levers.

According to a still further feature of the present invention, a material web travel path may be formed between the bottom roll of an upper roll stack and the top roll of a lower roll stack.

The present invention may also be directed to a calender for processing a material web that may include a first and second roll stack substantially linearly arranged and a space greater than a thickness of the material web located between the first and second roll stacks.

According to another feature of the present invention, each of the first and second roll stack may include a bottom roll movable in a direction of the linear arrangement.

According to another feature of the present invention, each of the first and second roll stack may include a bottom roll movable in a direction transverse to the linear arrangement.

According to a further feature of the present invention, each of the first and second roll stack may include a bottom roll and the calender may also include a sled associated with each of the first and second roll stack for enabling movement of the bottom roll. Further, the sled may include a bearing recess to accommodate a bearing pin of the bottom roll. Further, the sled may also include a roll-out rail arranged transverse to the linear arrangement. Still further, the sled may include a stop for restricting movement of the bottom roll.

According to still another feature of the present invention, the first roll stack may include a top roll and a bottom roll and at least one intermediate roll positioned between the top and bottom roll. Further, the at least one intermediate roll may include a heated roll. Still further, the calender may include a lever and a stanchion. The at least one intermediate roll may be coupled to the stanchion via the lever.

According to a still further feature of the present invention, the calender may include a stanchion located parallel to the linear arrangement and a transverser coupled to the stanchion for movement parallel to the linear arrangement.

According to another feature of the present invention, the first and second roll stack may be mounted on a common stanchion.

According to yet another feature of the present invention, a bottom roll of the first roll stack may be coupled to a sled. The sled may facilitate removal of the bottom roll from the first roll stack.

According to yet another feature of the present invention, the first and second roll stacks are separately operable.

Other exemplary embodiments and advantages of the present invention may be ascertained by reviewing the present disclosure and the accompanying drawing.

BRIEF DESCRIPTION OF THE DRAWINGS

The present invention may be further described in the detailed description which follows, in reference to the noted drawing by way of non-limiting example of a preferred embodiment of the present invention, and wherein:

The FIGURE illustrates a calender having two substantially vertically aligned roll stacks in accordance with the present invention.

DETAILED DESCRIPTION OF THE PREFERRED EMBODIMENTS

The particulars shown herein are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawing figure making apparent to those skilled in the art how the invention may be embodied in practice.

A calender 1 may include two roll stacks, e.g., upper roll stack 2 and lower roll stack 3, which may be positioned one atop the other on a common stanchion or support bracket 4.

Upper roll stack 2 may include a top roll 5 formed by a deflection compensation roll having a deflection compensation device 6 acting in a downward direction, and a bottom roll 7 likewise formed by a deflection compensation roll having a deflection compensation device 8 operating in an upward direction. Upper roll stack 2 may also include three intermediary rolls 9, 10, and 11 positioned between top roll 5 and bottom roll 7. Further, intermediary rolls 9 and 11 may be heated, e.g., via heating conduits located in the region of the roll circumference.

Intermediary rolls 9, 10, and 11 may be coupled to stanchion 4 via levers 12, 13, and 14, respectively. Top roll 5 may be coupled, e.g., in a stationary manner to stanchion 4, while bottom roll 7 may be coupled to a movable sled 15. Movable sled 15 may be moved, e.g., parallel to stanchion 4, via a hydraulic cylinder 16. In this manner, hydraulic cylinder 16 may be supported on a bearing element 17 affixed to stanchion 4, e.g., in a stationary manner. Further, the parallel movement of sled 15 enables the lower roll 7 to be loosened from the roll stack.

As with conventional calender devices, a plurality of guide rolls 18, 19, and 20 may be provided. A material web 21, e.g., a paper web, may be guided through nips formed between individual rolls 5, 9, 10, 11, and 7. However, it is not necessary that material web 21 be wound around rolls of upper roll stack 2 by a greater angle. Further, guide rolls 18 and 19 may be driven.

Lower roll stack 3 may be constructed or formed in substantially the same manner as upper roll stack 2. The individual elements, i.e., rolls, of lower roll stack 3 which correspond to the rolls of upper roll stack 2 have been designated in the Figure with a same reference numeral increased by 100. Thus, a top roll 105 of lower roll stack 3 may be supported on bearing element 17, which is mounted in a stationary manner on stanchion 4 and in which hydraulic cylinder 16 is supported for moving bottom roll 7 of upper roll stack 2.

However, in lower roll stack 3, to ensure that each side of web 21 may be treated or processed, the position of the guide rolls with respect to the roll stack is opposite that discussed with respect to the upper roll stack 2. Material web 21 may be guided through a wide "reversing nip" 22 formed between bottom roll 7 of upper roll stack 2 and top roll 105 of lower roll stack 3. The term "reversing nip" is utilized to indicate that the material web is treated on a first side in upper roll stack 2, and upon passing through "reversing nip" 22, will be treated on a second side by lower roll stack 3. Thus, the "reversing nip" may be formed by a gap having a gap distance greater than the thickness of the material web being processed, which is likewise greater than a gap distance between adjacent rolls in a same roll stack that process the material web. Accordingly, web 21 may travel through lower roll stack 3 in a substantially mirror image fashion relative to upper roll stack 2. With the substantially identical construction of roll stacks 2 and 3, material web 21 may be treated in practically same manner on both sides. Correspondingly, the arrangement of guide rolls 118–120 depends upon roll plane 23, i.e., a plane which includes the axes of the rolls in the upper and lower roll stacks.

As shown in the FIGURE, bottom rolls 7 and 107 may be supported in bearing recesses 24 and 124, respectively, which may be coupled to roll-out rails 25 and 125, respectively, having stops 26 and 126, respectively. Generally, bottom rolls 7 and 107 may be difficult to remove because they may only have relatively short roll pins. Thus, it may be difficult to slide tools onto the short roll pins for removing the bottom rolls. However, as shown, via bearing recesses 24, bottom roll 7 (or 107) may be rolled out from bearing recess 24 (or 124) until it contacts stop 26 (or 126), illustrated in the FIGURE by dashed lines. Bottom roll 7 may be engaged there by a removal tool and removed, e.g., via a hoisting mechanism illustrated as a crane hook 27 with cables 28. The removed roll may be stored on a roll carriage 29.

In front of roll stacks 2 and 3, i.e., on a side of roll stacks 2 and 3 remote from (or opposite) stanchion 4, a traverser 30, which may be common to both roll stacks, may be installed on a stanchion 31. In this manner, all of the rolls may be accessed via transverser 30. On a back side of roll stacks 2 and 3, a traverser 32 and, if necessary, a plurality of working platforms may be provided. In this manner, the back side of roll stacks 2 and 3 may be accessed by an operator 33.

An out-of-service stanchion of a 12-roll calender may be utilized as stanchion 4. If necessary, only the arrangement of the guide rolls and the embodiment of the levers must be changed. A change of this kind, however, may be carried out with much fewer problems than construction of a new stanchion.

It is noted that the foregoing examples have been provided merely for the purpose of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the invention in its aspects. Although the invention has been described herein with reference to particular means, materials and embodiments, the invention is not intended to be limited to the particulars disclosed herein; rather, the invention extends to all functionally equivalent structures, methods and uses, such as are within the scope of the appended claims.

What is claimed:

1. A calender comprising:

two separately operable roll stacks;

each roll stack including a top roll composed of a deflection compensation roll and a bottom roll composed of a deflection compensation roll;

the two roll stacks being arranged one atop the other to form an upper and a lower roll stack;

the top roll of the lower roll stack being fixedly mounted; and a bearing device being adapted to movably support the bottom roll of the upper stack.

2. The calender according to claim 1, both roll stacks being arranged in a common machine frame.

3. The calender according to claim 2, each roll stack including five rolls; and the machine frame including a 12-roll calender machine frame.

4. The calender according to claim 1, the top roll of the lower roll stack and the bottom roll of the upper roll stack being located on the bearing device.

5. The calender according to claim 1, further comprising a plurality of intermediary rolls positioned between the top roll and the bottom roll, the intermediary rolls being supported on levers.

6. The calender according to claim 1, a material web travel path being formed between the bottom roll of the upper roll stack and the top roll of the lower roll stack.

7. The calender in accordance with claim 1, the bearing device being adapted to movably support the bottom roll of the upper stack for movement within a roll plane.

8. A calender comprising:

two separately operable roll stacks composed of a plurality of rolls;

each roll stack including a top roll composed of a deflection compensation roll and a bottom roll composed of a deflection compensation roll;

the two roll stacks being arranged one atop the other;

a center of each of the plurality of rolls being arranged in a common plane;

roll out rails extend laterally to the common plane;

bearing recesses being located adjacent to the roll out rails; and at least the bottom roll of an upper roll stack being supported in the bearing recesses.

9. A calender for processing a material web comprising:

a first and second roll stack substantially linearly and vertically arranged;

the first and second roll stacks being spaced from each other a distance greater than a spacing between adjacent rolls in a same roll stack;

a roll of the first roll stack located adjacent to the second roll stack being fixedly mounted; and a roll of the second roll stack located adjacent to the first roll stack being movably mountable for movement relative to the fixedly mounted roll of the first roll stack.

10. The calender according to claim 9, each of the first and second roll stacks comprising a bottom roll movable in a direction of the linear arrangement.

11. The calender according to claim 9, each of the first and second roll stacks comprising a bottom roll movable in a direction transverse to the linear arrangement.

12. The calender according to claim 9, the first roll stack comprising:

a top roll and a bottom roll; and at least one intermediate roll positioned between the top and bottom rolls.

13. The calender according to claim 12, the at least one intermediate roll comprising a heated roll.

14. The calender according to claim 12, further comprising:

a lever;

a stanchion, the at least one intermediate roll coupled to the stanchion via the lever.

15. The calender according to claim 9, further comprising:

a stanchion located parallel to the linear arrangement; and a transverser coupled to the stanchion for movement parallel to the linear arrangement.

16. The calender according to claim 9, the first and second roll stacks being mounted on a common stanchion.

17. The calender according to claim 9, a bottom roll of the first roll stack coupled to a sled, wherein the sled facilitates removal of the bottom roll from the first roll stack.

18. The calender according to claim 9, the first and second roll stacks being separately operable.

19. A calender for processing a material web comprising:

a first and second roll stack substantially linearly arranged;

the first and second roll stacks being spaced from each other a distance greater than a spacing between adjacent rolls in a same roll stack;

each of the first and second roll stacks comprising a bottom roll; and a sled associated with each of the first and second roll stacks for enabling movement of the bottom roll.

20. The calender according to claim 19, the sled comprising a bearing recess to accommodate a bearing pin of the bottom roll.

21. The calender according to claim 19, the sled comprising a roll-out rail arranged transverse to the linear arrangement.

22. The calender according to claim 19, the sled comprising a stop for restricting movement of the bottom roll.

* * * * *